United States Patent [19]

Stilling

[11] Patent Number: 4,547,987

[45] Date of Patent: Oct. 22, 1985

[54] SIGN STRUCTURE

[76] Inventor: Johann Stilling, 1141 Royal York Rd., Apt. A1001, Islington, Ontario, Canada, M9A 4A9

[21] Appl. No.: 598,981

[22] Filed: Apr. 11, 1984

Related U.S. Application Data

[63] Continuation-in-part of Ser. No. 458,771, Jan. 18, 1983, Pat. No. 4,516,343.

[51] Int. Cl.[4] ..... G09F 13/04

[52] U.S. Cl. ..... 40/574; 40/549; 40/603

[58] Field of Search ..... 40/549, 603, 574; 160/391, 395, 398

[56] References Cited

U.S. PATENT DOCUMENTS

| | | | |
|---|---|---|---|
| 1,600,243 | 9/1926 | Passmore | 40/564 |
| 3,830,033 | 8/1974 | Gahler | 160/391 |
| 4,169,327 | 10/1979 | Stilling | 40/549 |
| 4,452,000 | 6/1984 | Gandy | 40/603 |

*Primary Examiner*—Robert P. Swiatek

*Assistant Examiner*—Cary E. Stone

*Attorney, Agent, or Firm*—George A. Rolston

[57] ABSTRACT

An intermediate frame for a sign box of the type having a first hinging member around its perimeter, and having an outer face frame for supporting a face panel, the intermediate frame having a generally rectangular construction with two ends, and a top and bottom joining at corners, each of them having an outer wall, a face panel support connected with the outer wall and extending inwardly, for supporting a face panel, a first hinging portion connected to the outer wall, and extending in a rearward direction for hinging interengagement with the first hinging member on the sign box, a second hinging member connected to the outer wall, and extending in a forward direction, to receive a second hinging portion carried on the outer face frame.

Also included are a series of face frames for supporting a panel of flexible sign material, and panel tensioning members for use therewith. Such face frames may be hingedly mounted to a sign box, fixed to a vertical structure, and retrofitted to an existing sign box.

13 Claims, 10 Drawing Figures

SIGN STRUCTURE

This application is a continuation in part of application Ser. No. 458,771 filed 1/18/83 for illuminated signs now U.S. Pat. No. 4,516,343.

The invention relates to illuminated signs of the type having a fixed box portion, and a moveable face panel, and in particular to the construction of the face frame of the sign.

Sign box construction using extruded components for the sign box, and the face frame, is disclosed in U.S. Letters Pat. 3,863,372. This form of construction has proved to be highly satisfactory in practice and is in wide use. The sign face panel usually formed of plastic material is supported in the face frame. The face frame is then hingedly mounted on the fixed portion of the box, which contains the lighting.

There are however cases where variations are required in the type of sign face. For example, in some cases it is desirable to provide a composite sign face having two spaced apart plastic panels. One plastic panel bears information which is constant, and the other sign panel may bear information which can be changed at intervals.

In some other cases it is desireable to fabricate the sign face out of thin sheet plastic material, rather than the usually relatively thick rigid plastic material that has been used in the past. The thin sheet material has certain advantages from the view point of economy and is also somewhat easier to print. Support systems for such flexible material have been proposed in U.S. Pat. No. 4,265,039, but are unnecessarily complex.

For these reasons it is desireable to provide a modified form of face frame, so that different such faces may be provided without changing the design of the fixed part of the sign.

It is also desireable to provide a face frame which is suitable for the mounting of a thin flexible sheet sign face, without changing the design of the sign box.

In the present invention these two objectives are achieved in a single component which may be used for either purpose. Clearly, however, two separate components could be made, one to meet each objective. It is intended that the invention may be practised in both ways, i.e., using a single dual-purpose component, or using two components, one for each purpose.

In one embodiment therefore the invention will be seen to comprise an intermediate frame adapted to be located between the front frame and the sign box. The intermediate frame has an intermediate hinge adapted to be hingedly mounted in a box hinge recess on the sign box, and is also provided with an intermediate hinge recess so that it is adapted to provide a hinge mounting for a front hinge on the front frame. The intermediate frame is adapted to carry an intermediate face panel, and the front frame is adapted to carry a front face panel. In this way, the intermediate frame can be placed in position on the box and fastened, and the front frame can then be hingedly mounted on the front of the intermediate frame, and also fastened.

In one embodiment of the invention the intermediate hinge recess on the intermediate frame is also adaptable for use with the thin flexible sheet plastic face panel material. In this embodiment the invention is of course used without the front frame at all. In this embodiment, the mounting of the thin sheet material to the intermediate frame is achieved by a core member which is adapted to receive an edge of the thin sheet material, and will then provide a core on which such material may be folded or wound. Such core member is then movably fastened to a suitable surface in the intermediate frame.

It will however be appreciated that the invention also envisages the provision of a face frame which is particularly adapted to the mounting of thin flexible sheet material, and which is provided with suitable surfaces for cooperation with such thin sheet material, and core member, and need not in this case be also adaptable for any other purpose. In this case, the face frame for the thin sheet material would not have been provided with the intermediate or other hinge recess but would simply be provided with any suitable surfaces on which the thin sheet material and core member may be received.

It will also be appreciated that different face frames for mounting a thin flexible sign material may be provided for direct mounting on a vertical surface, with or without a source of illumination, for hinged mounting on a suitable sign box, or for retrofitting a flexible sign face to a pre-existing sign or other structure.

The invention also comprises the provision of a core member for fastening and supporting thin sheet face panel material on a face frame.

The various features of novelty which characterize the invention are pointed out with particularity in the claims annexed to and forming a part of this disclosure. For a better understanding of the invention, its operating advantages and specific objects attained by its use, reference should be had to the accompanying drawings and description which illustrates and describes preferred embodiments of the invention.

IN THE DRAWINGS

Figure 1:
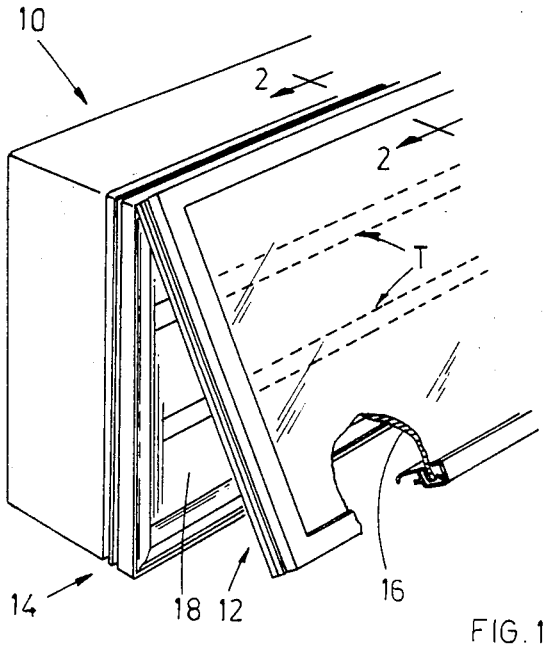
FIG. 1 is a perspective illustration showing a portion of a sign box.

As best shown in FIG. 1, the invention relates to illuminated signs, usually outdoor signs, although they may also be used indoors, such signs typically being used on store fronts and the like. Such signs may be mounted directly on the store front, or may be mounted free standing on a post, or some other form of supports, and may have a single face giving information or may have two faces one on either side.

For the sake of simplicity of a single face sign is illustrated, but it will of course be appreciated that a double faced sign could equally well be made in the same way.

Again as shown in FIG. 1 such an illuminated sign will be seen to comprise a fixed sign box portion 10 and a front face frame 12, and is further provided with an intermediate face frame 14, located between the front face frame 12 and the sign box 10. The sign box 10 contains a lighting source, typically lighting tubes T. The front face frame 12 supports an outer sign face panel 16, and the intermediate support frame 14 supports an intermediate face panel 18. The face panel 18 may if desired carry information of a more-or-less permanent or long lasting nature, and the outer face panel 16 may be used to display information of a more rapidly changing nature. The outer panel 16 may be transparent in places, so as to reveal the information on the intermediate panel 18. Alternatively the outer panel 16 may simply be removable and replaceable over the top of the intermediate panel 18 so as to provide two different information messages at for example different times of day or different times of the week.

As stated above, one form of sign box construction is shown in U.S. Letters Pat. No. 3,863,372, and certain of the portions of the sign box and face frame structure of the present invention, are designed with generally similar features.

It will of course be understood however that the present invention is not to be construed as being limited to the form of construction shown in U.S. Pat. No. 3,863,372. The present inventions are applicable to sign boxes of a wide variety of different constructions having different hinging formations, and other different features, the present form of construction being described simply for the sake of example.

Figure 2:
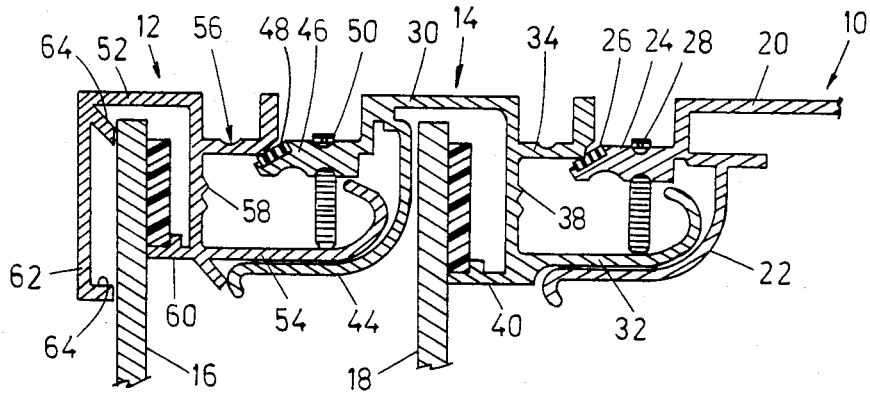
FIG. 2 is a section along the line 2—2 of FIG. 1.

Thus as shown in FIG. 2, the sign box 10 is shown generally as comprising a main wall 20, only a portion of which is shown for the sake of simplicity, and which is generally of the same design both on the top and bottom and opposite ends of the box. As described however it is not necessary that the wall 20 be of identical construction on all four sides of the box 10.

The outer wall 20 of sign box 10 is provided with a first hinging member which in this particular embodiment is illustrated by the generally concavely curved wall formation 22 extending downwardly and forwardly with respect of the main wall 20. A sealing wall 24 is also connected to the main wall 20, and extends forwardly therefrom spaced above the generally concave hinging member 22. It is provided with a sealing strip 26 formed of resilient material such as rubber, plastic and the like.

A retaining screw or other retaining member 28 extends through the wall 24 for purposes to be described below.

The intermediate face frame 14 will be seen to comprise an outer wall 30, having a first hinging portion 32 extending rearwardly therefrom. The first hinging portion 32 in this embodiment is illustrated in the form of a generally convexly curved hinging portion adapted to cooperate with the convex curvature of the first hinged member 22 of sign box 10. Intermediate frame 14 also has a first sealing wall portion 34 extending rearwardly, for interengagement with the sealing strip 26 of sealing wall 24.

A junction wall 38 extends in a generally L-shape from outer wall 30, and connects with convex member 32 and sealing wall 34. It has an inner retaining strip 40, shaped in a suitable manner to provide retaining means for the intermediate face panel 18. Panel 18 is held in position by any suitable means such as the retaining strip or wedge 42.

As noted above the intermediate face frame 14 is not only hingably mounted on the main sign box 10, but also provides a hinge mounting for the front face frame 12.

For this purpose, and purely by way of example, it is provided with a second hinging member, in this case the concave wall formation 44 extending downwardly and forwardly from outer wall 30. Wall 44 is of the same shape and configuration as concave wall 22 of sign box 10.

Intermediate frame 14 also has second sealing wall means 46, supporting a suitable resilient sealing strip 48. Further retaining means illustrated generally as a retaining screw 50, are provided in the second sealing wall 46 for purposes to be described.

The front face frame 12 comprises an outer main wall 52, and a second hinging portion for cooperation with the second hinging member of intermediate frame 14. In this case the second hinging portion comprises a generally convexly curved wall member 54 shaped to cooperate with the concavely shaped wall member 44 and provide hinging action. It will of course be understood however that the use of such concave and convexly shaped hinged means is illustrated purely by way of example, and is not to be regarded as limiting to hinging means of this particular shape or action. Other forms of hinging means are suitable, and may be substituted therefor without departing from the scope of the invention.

A second sealing wall 56 extends rearwardly from outer wall 52, for intergagement with the sealing strip 48.

A junction wall 58 is connected in a generally shaped manner to the outer wall 52, and connects with walls 56 and 54. A retaining strip 60 is also joined to wall 58, for assisting in retaining the outer face panel 16 in position.

An outer retaining wall 62 extends in a L-shaped manner from the forward edge of outer wall 52, and extends parallel with wall 58 to provide a generally recessed channel for reception of the edge of outer face panel 16 in the manner shown. Suitable retaining strips 64 are provided for cooperating with retaining strip 60 and securing the panel 16 in position.

In operation, the panel 18 may be provided, carrying one form of information, and the panel 16 may carry information which is complimentary to the information on panel 18, or may simply replace it.

In the majority of cases portions of panel 16 will be transparent so that panel 18 can be seen behind panel 16. In this way the information on panel 16 can vary the information on panel 18, or can simply complete gaps in the information on panel 18 as desired.

The assembly of the invention will consist essentially in first of all constructing and erecting the sign box 10 in position. The intermediate face frame 14 will then be placed in position by sliding the convex hinge member 32 inwardly over the surface of the concave hinge member 22. When the two are seated together as shown in FIG. 2, two or more retaining members 28 may be inserted so as to hold them in position. Members 28 are of such a nature that while they prevent the member 32 from being withdrawn, the entire structure of intermediate frame 14 may be swung forwardly and upwardly, giving access to the interior of sign box 10 for servicing and the like.

While only the top edge of such sign box 10 and intermediate frame 14 have been shown, it will be appreciated that the construction of the lower edge in this particular embodiment will be generally similar, as will be the construction of the two side edges.

For the sake of security further retaining members such as bolts or screws 28 may be inserted along the lower edge so as to secure the intermediate face frame 14 in position.

The front face frame 12 is then connected, simply by sliding the convex member 54 inwardly over the concave member 44. When seated, retaining members such as screws 50 may then be inserted as shown. Similarly such screws 50 will prevent withdrawal of member 54 from member 44, but will permit upward hinging action of the entire frame 12 relative to the intermediate frame 14.

As before, if desired the lower edge can also be secured by similar screw 50.

It will thus be seen that by provision of the intermediate face frame having hinging formations adapted to cooperate with both the main sign box 10 and also the front face frame 12, a much more flexible adaptable sign is provided having a wider range of use.

At the same time, in this embodiment of the invention the sign box 10 can be used without the intermediate face frame 14, simply by using the front face frame 12, being hingably connected directly to the sign box 10.

In accordance with a further embodiment of the invention, the sign face panel which is normally rigid, typically being an acrylic plastic material, may be replaced by a thin flexible plastic sign face material. Such thin flexible materials are less expensive, and are in certain circumstances easier to print, thereby making an economical sign having many of the features of the more expensive sign having a rigid face panel.

In order to do this, provision is made for attachment and retention of the thin sheet material around its edges so that it may be held secure and tight.

Figure 3:
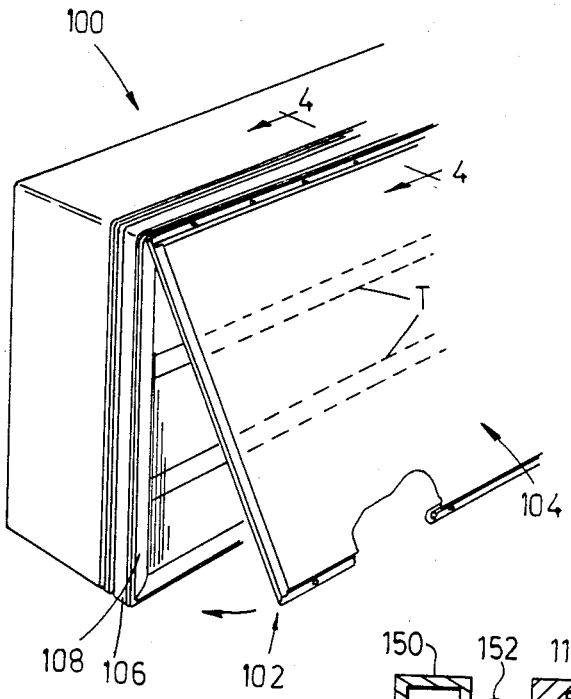
FIG. 3 is a perspective illustration of a further embodiment of the invention.

As best shown in FIG. 3 a sign box is illustrated generally as 100, having a face frame indicated as 102, carrying a thin flexible face panel 104. As before, suitable illumination is provided within sign box 100 for example by means of tubes T.

Figure 4:
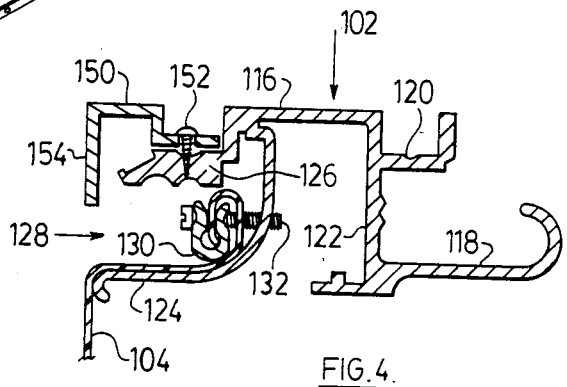
FIG. 4 is a section along the line 4—4 of FIG. 3.

Referring now to FIGS. 3 and 4, it will be seen that the sign box 100 comprises a main outer wall 106, having any suitable hinging formation such as the generally concave wall 108 and having a sealing wall, a sealing strip and a retaining screw similar to FIG. 2.

As explained above, however, the use of such a concave hinging wall 108 is but one of different ways in which such a hinging action may be provided, and the sealing wall and strip may not always be necessary, depending upon the design of the particular form of hinge.

The face frame 102, for carrying the thin flexible panel 104 in this particular embodiment of the invention, is the same extrusion as that of the intermediate face frame 14 of FIG. 2. This however, is simply a matter of convenience and economy, and as described below, other forms of face frame may be substituted for the face frame 102, while still providing effective support for the flexible panel 104.

Thus in the embodiment of FIG. 4, the face frame 102 comprises an outer wall 116, and a generally rearwardly directed hinging portion comprising the convex wall 118 shaped to interengage with the concave wall 108.

A sealing wall 120 is also provided for cooperation with the seal on sign box 100.

A junction wall 122 connects in a L-shaped fashion with wall 116, and provides support for hinge wall 118 and sealing wall 120.

A forwardly directed concave wall 124, and sealing wall 126 are provided, similar to walls 44 and 46 in the embodiment of FIG. 2, and define between them an elongated channel or recess 128 for reception of the edge of flexible panel 104. In particular, concave wall 124 defines a rim around which material 104 may be supported.

Panel 104 is retained in recess 128 by means of a core member 130 cooperating with wrapping member 131 and a series of retaining screws 132. Screws 132 pass through core member 130 at intervals and are threadedly engaged in a portion of the concave wall 124 as shown.

Figure 5:
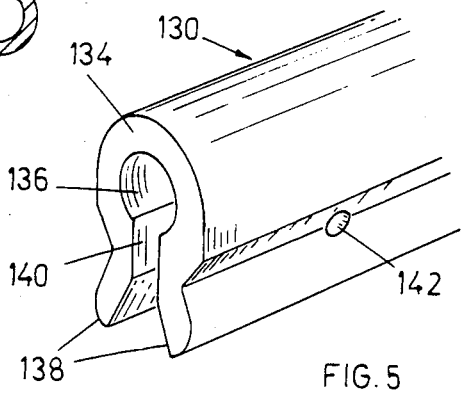
FIG. 5 is a perspective illustration of the core member for use with the FIG. 3 embodiment.

Core member 130 is shown in more detail in FIG. 5 and will be seen to consist of a generally semi-cylindrical wall 134, having a generally semi-cylindrical hollow interior 136, and having two continuous outwardly divergent angled lips 138, defining a narrow elongated slit-like opening 140. A plurality of fastening holes 142 are provided therealong at intervals. Ridge or groove formations 143 are provided along the ends of lips 138 and on their inner sides.

Wrapping member 131 comprises a generally cylindrically shaped member, which may loosely fit within hollow interior 136. Wrapping member 131 may conveniently have a circular cross-section, although other shapes may be suitable.

As best shown in FIG. 4, an edge portion of flexible panel 104 is wrapped around wrapping member 131 within hollow interior 136. The diameter, or other minimum cross-sectional dimension, of wrapping member 131 is sufficiently large to retain wrapping member 131 with panel 104 wrapped around it within interior 136. Thus, wrapping member 131 is unable to pass through opening 140 and jams panel 104 against the mouth of opening 140 at hollow interior 136. Such jamming action prevents the escape of panel 104 from core member 130. Formations 143 assist such actions.

The retaining screws 132 are then passed through the wound up material 104 and through holes 142 in core 130, and threaded into the concave wall 124 as shown. They can then be tightened up so as to apply tension to the material 104 somewhat in the manner of a drum skin.

A cover member 150 may be fastened by screws 152 to the front sealing wall 126. Member 150 has a front face 154 partially closing off channel 128 to improve its appearance, and to avoid tampering, and weather damage.

As explained above, while the extrusion 102 is of the same shape as the extrusion 14 of FIG. 2, and thus provides an economy of usage for such extrusion, it may be that different extrusions can be used for achieving the purpose of supporting the flexible panel 104.

Figure 6:
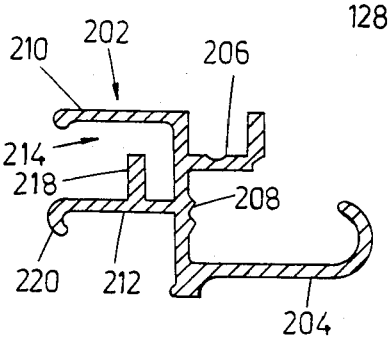
FIG. 6 is a sectional illustration of an alternate embodiment for use in association with the FIG. 3 embodiment.

An example of such a different form of extrusion is shown in FIG. 6.

In this case, the face frame is shown generally as 202, and has a rearwardly extending hinge formation, in this case being shown as the convex wall 204 and a sealing wall 206, so that it is adapted to cooperate with the form of sign box 100 as shown in FIG. 3. As explained, however, it is not necessary for purposes of the invention that the invention be limited to the sign box 100, and other forms of sign box with other hinging means may be provided with or without sealing walls as desired.

A junction wall 208 connects hinging wall 204 and sealing wall 206. An outer main wall 210 connects to junction wall 208 in a generally L-shaped manner and extends forwardly.

A lower retaining wall 212 is also connected to junction wall 208 being spaced apart from outer wall 210 so as to define therebetween an elongated channel or recess 214. A fastening strip 218 is provided for the reception of fastening screws 132. In this way, it is possible to attach core member 130 in position.

Retaining wall 212 acts as a rim around which material 104 may be wrapped. Preferably the retaining wall 212 will have a generally rounded lip portion 220 so that the flexible material 104 may be tightened there around without cutting it.

Numerous other forms of face frame extrusion may also be suitable having different forms of hinge means or different functions and different means of fastening and tightening the flexible panel 104.

Figure 7:
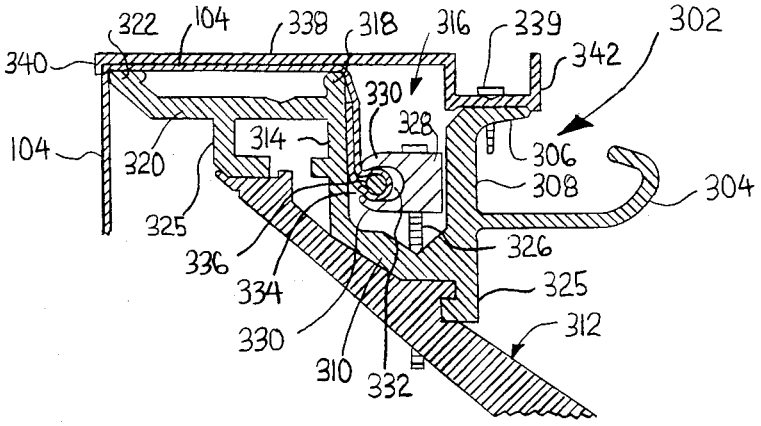
FIG. 7 is a sectional illustration of further embodiment for use in association with the FIG. 3 embodiment.

Further examples are illustrated in FIGS. 7 to 10. FIG. 7 illustrates an alternate embodiment of a face frame 302, corresponding generally to face frame members 12, 102, and 202 of FIGS. 2, 4, and 6 respectively. Face frame 302 has a rearwardly extending hinge formation, in this case being shown as the convex hinging wall 304, and a sealing wall 306, so that it is adapted to cooperate with the form of sign box 100 as shown in FIG. 3. As explained, however, it is not necessary for the purposes of the invention that the invention be limited to the sign box 100, and other forms of sign box with other hinging means may be provided with or without sealing walls as desired.

A junction wall 308 connects hinging wall 304 and sealing wall 306. Extending from the lower portion of junction wall 308 is a generally upwardly and frontwardly extending support wall 310. The lower surface of support wall 310 may be adapted to be supported on a frame member 312. A generally upwardly-extending stretching wall 314 extends from support wall 310. An elongated channel or recess 316 is defined by junction wall 308, support wall 310 and stretching wall 314. Stretching wall 314 defines a rounded free end 318. A forwardly extending cantilever wall 320 extends from stretching wall 314 and defines an upwardly and forwardly angled end portion with a rounded free end 322. Together cantilever wall 320 and stretching wall 314 define a rim around which material 104 may be held, as described below. A downwardly extending L-shaped support wall 324 extends from cantilever wall 320. Support wall 324 is adapted to cooperate with frame member 312 to support face frame member 302. Junction wall 308 may also cooperate with frame member 312 for the same purpose. FIG. 7 illustrates a junction wall 308 defining a generally downwardly extending, forwardly facing L-shaped member 325 adapted to cooperate with corresponding surfaces of frame member 312.

It will of course be appreciated that other shapes may be used for the surfaces of face frame member 302 required to cooperate with frame member 312, according to the shape and configuration of such frame member 312. Frame members 312 may not be continuous along the length of face frame 302, but rather are most conveniently placed at spaced apart locations along such length to provide face frame 302, with satisfactory support. Therefore, there will be many locations along the length of face frame 302 which will not actually be in contact with such frame members 312. However, for ease in manufacturing and assembly, the entire length of face frame 302 is made capable to cooperate with such frame members 312.

Support wall 310 defines a threaded hole between junction wall 308 and stretching wall 314 for receiving a fastening screw 326. A core member 328 defines a suitable hole through which the shank of screw 326 may loosely pass. Screw 326 thereby holds core member 328 within channel 316. Preferably, screw 326 is located so that it does not interfere with frame member 312.

Core member 328 defines two arms 330, extending generally perpendicularly to the axis of screw 326 towards stretching wall 314. Cavity 332 is defined between such arms 330. Arms 330 curve inwardly towards each other at their free ends. A gap 334 is defined between the free ends of arms 330, thereby allowing cavity 332 to communicate with channel 316. Ridge or groove formations may be provided on arms 330 as in the embodiment of FIG. 5.

Disposed within cavity 332 is wrapping member 336. Wrapping member 336 is small enough to freely move within cavity 332, and may be small enough that it may pass through gap 334, by itself, with minimum clearance.

The flexible material 104 which forms the front panel of the sign passes over the free end 332 of cantilever wall 320 and over the free end 318 of stretching wall 314. Material 104 continues down through channel 316 through gap 334, around wrapping member 336 and thence outwardly through gap 334. The thickness of wrapping member 336 with material 104 wrapped around it is greater than the size of gap 334. Consequently, the application of tension to material 104 will cause wrapping member 336 to be pulled toward gap 334 where material 104 will become jammed between member 336 and arms 330. The application of additional tension will increase the jamming effect and will prevent movement of member 336 relative to core member 328. Such jamming will also prevent material 104 from slipping. Ridge or groove formations may be provided on arms 330 to hold material 104 securely.

In installation, screw 326 is positioned so that core member 328 may be moved away from support wall 310. An edge of material 104 is loosely fitted over face frame 302 and around wrapping member 336 as described above. Preferably, material 104 is tightened as far as possible by hand, at least to take up as much slack from material 104 as possible. The application of tension to material 104 will cause wrapping member 336 to jam between arms 330. Screw 326 is then turned to move core member 328 towards support wall 310. Such motion will increase the tension in material 104 until the desired tension is achieved.

A cover 338 may be affixed by suitable means (such as by bolts 339) to sealing wall 306. Cover 338 may have a front face 340 covering the bend in material 104 at free end 322 to improve the appearance of the sign. The cover 338 may also have a surface 342 at the sealing wall 306 which may cooperate with sealing wall 306 and box 100 to effect a weatherproof seal.

Figure 8:
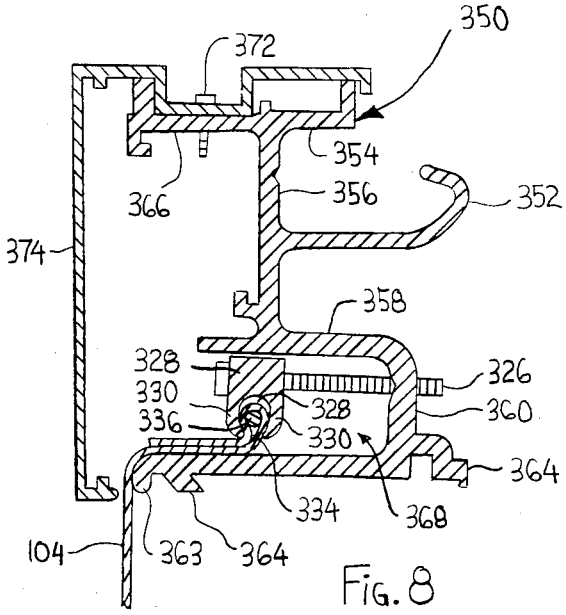
FIG. 8 is a sectional illustration of a further embodiment for use in association with the FIG. 3 embodiment.

FIG. 8 illustrates a further embodiment of the invention. There is shown a face frame 350 which defines a rearwardly extending hinge formation, in this case being the convex hinging wall 352 and a sealing wall 354, adapted to cooperate with the form of sign box 100 (FIG. 3). Other forms of sign box with other hinging means may be provided with or without sealing walls, as desired.

A junction wall 356 connects hinging wall 352 and sealing wall 354. Extending from the bottom of junction wall 356 is a generally horizontal wall 358. Extending generally downwards from a rearward portion of horizontal wall 358 is screw supporting wall 360. Extending generally forwardly from the bottom of screw supporting wall 360 is stretching wall 362. Stretching wall 362 defines a rounded free end 363 and a rim about which material 104 may be held as described below. Suitable frame supporting members 364 are defined on face frame 350 for cooperating with frame members (not shown) to provide adequate structural support to face frame 350. A cover support wall 366 extends essentially perpendicularly and forwardly from junction wall 356.

A channel or recess 368 is defined by horizontal wall 358, screw supporting wall 360 and stretching wall 362. Screw supporting wall 360 defines a threaded hole for receiving fastening screw 326. A core member 328 defines a suitable hole through which the shank of screw 326 may loosely pass. Screw 326 thereby holds core member 328 within channel 368.

Core member 328 is as described in the embodiment shown in FIG. 7. A wrapping member 336 fits loosely within cavity 332. Wrapping member 336 may be small enough that it may pass through gap 334, by itself, with minimum clearance.

Material 104 passes over the free end 363 of stretching wall 362, rearwardly along channel 368 alongside the upper side of stretching wall 362, and is held as previously described by cooperation between wrapping member 336 and core member 328.

Installation is identical to that for the embodiment of FIG. 7, except the, of course, channel 368 is essentially horizontal and material 104 defines only one corner, that is at free end 363.

A cover 370 may be affixed by suitable means (such as by bolts 372) to cover support wall 366. Cover 370 may have a front face 374 covering the corner in material 104 at free end 363 to improve the appearance of the sign.

Figure 9:
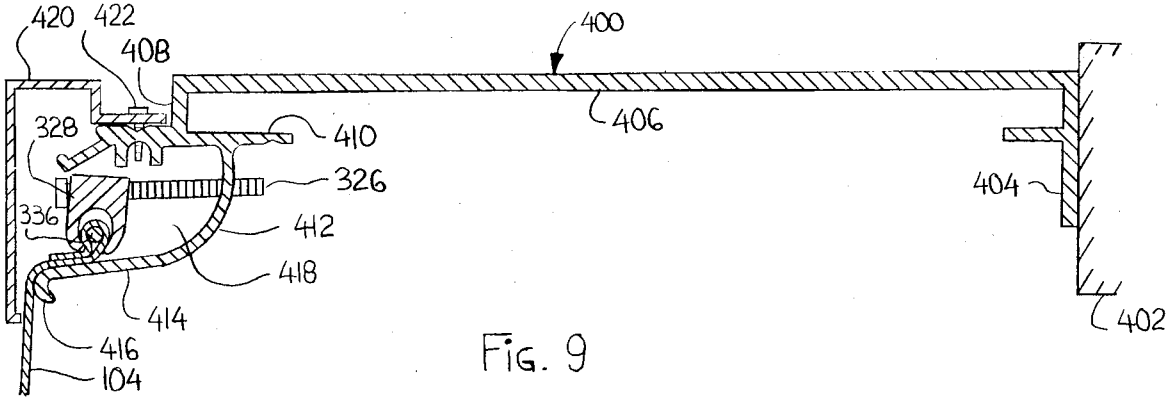
FIG. 9 is a sectional illustration of a further embodiment for use in association with a sign mounting surface, and, FIG. 10 is a sectional illustration of a further embodiment for use in association with a pre-existing sign or other structure.

FIG. 9 illustrates a further embodiment, showing a one-sided sign frame 400 which may be attached by suitable means (not shown) to a wall 402. Frame 400, as illustrated, is essentially the same as box 10 shown in FIGS. 1 and 2. Frame 400 defines a wall bracket 404 adapted to cooperate with suitable fastening means (not shown) for effecting such attachment. Extending forwardly from bracket 404 is box member 406, which will define the sides of a sign box within which illumination means (not shown) will be disposed.

Extending downwardly from the forward end of box member 406 is an essentially vertical wall 408, from the bottom of which extends an essentially horizontal wall 410. Extending generally downwards from a rearward portion of horizontal wall 410 is screw supporting wall 412. Screw supporting wall 412 curves forwardly and merges into stretching wall 414. Stretching wall 414 defines a rounded free end 416 and a rim about which material 104 may be secured, as described below.

A channel or recess 418 is defined by horizontal wall 410, screw supporting wall 412 and stretching wall 414. Screw supporting wall 412 defines a threaded hole for receiving fastening screw 326. A core member 328 wrapping member 336 and material 104 are supported within channel 418 as in the embodiment of FIG. 8.

Installation is identical to that for the embodiment of FIG. 8.

A suitable cover 420 may be attached either to box member 406 or horizontal wall 410, if desired.

Figure 10:
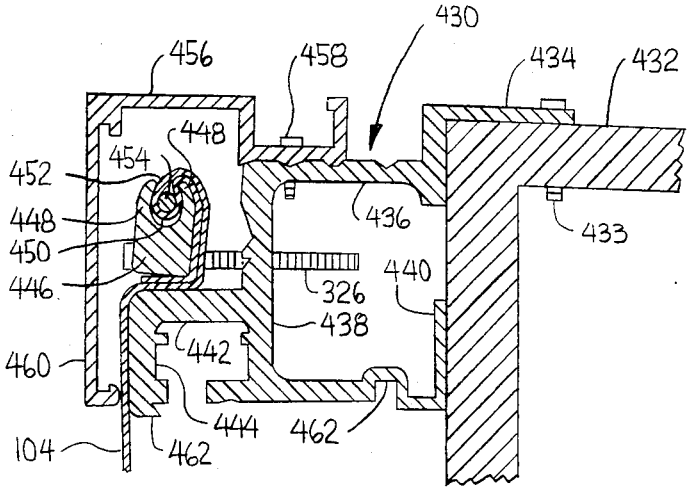

FIG. 10 illustrates a further embodiment, showing a sign frame 430 suitable for being retrofitted to any pre-existing sign, or other structure (indicated generally as 432), defining an essentially right angled upper corner.

Sign frame 430 defines an L-shaped corner member 434 adapted to fit around the right angled corner of structure 432. Frame 430 may be affixed to structure 432 by any suitable means, such as by screws 433 or by a hinge. Extending generally forwardly from corner member 434 is box member 436. Extending generally downwardly from a forward portion of box member 436 is junction wall 438. Extending rearwardly from junction wall 438 is a generally L-shaped wall 440 adapted to abut against the forward face of structure 432. L-shaped wall 440 thereby provides additional support for holding sign frame 430 against structure 432.

Extending forwardly from junction wall 438 is stretching wall 442. Extending generally downwardly from the forward end of stretching wall 442 is support wall 444. Stretching wall 442 and support wall 444 meet at a rounded corner. The lower end of support wall 444 is rounded on its forward side.

Walls 438, 442 and 444 define an inner channel which may be used to receive joiners and corner braces (not shown) for holding frame 430 together.

Junction wall 438 defines a threaded hole above stretching wall 442 for receiving a fastening screw 326. A core member 446 defines a suitable hole through which the shank of screw 326 may loosely pass. Screw 326 thereby holds core member 446 above stretching wall 442.

Core member 446 defines arms 448, cavity 450 and gap 452 and is shaped identically to the core member 328 of the embodiments of FIGS. 7 to 9, however arms 448 extend away from stretching wall 442.

Disposed within cavity 450 is wrapping member 454. Wrapping member 454 is small enough to freely move within cavity 450, and may be small enough that it may pass through gap 452, by itself, with minimum clearance.

In installation, screw 326 may be positioned so that core member 446 may be moved away from junction wall 438. An edge of material 104 is loosely fitted over the forward surface of support wall 444 and along the upper surface of stretching wall 442, beneath core member 446. Material 104 continues up the rearward side of core member 446. A suitable slot means (not shown) may be formed from the edge of material 104 in order to pass material 104 around screw 326. Alternatively, a hole of pre-determined size may be formed near the edge of material 104 prior to installation. In such a case, material 104 is threaded through core member 446, as described below, and screw 326 passed through core member 446 and material 104 prior to being screwed into junction wall 438.

Material 104 continues upwardly past screw 326 to the top of core member 446. Material 104 passes over rear arm 448, through gap 452, around the forward side of wrapping member 454, around the bottom and rearward sides of wrapping member 454. Material 104 exits through gap 452 and passes around rear arm 448 and passes downwardly between core member 446 and the first layer of material 104. Suitable slot or hole means (not shown), as described above, must be provided to allow material 104 to pass around screw 326. The end of material 104 passes beneath core member 446 to a point where the end of material 104 may be conveniently trimmed.

Preferably, material 104 is tightened as far as possible by hand, at least to take up as much slack from material 104 as possible. Tension applied to material 104 will cause wrapping member 454 to jam between arms 448, thus preventing slipping of material 104. Screw 326 is then turned to move core member 446 towards junction wall 438. Such motion will increase the tension in material 104 until the desired tension is achieved.

A cover 456 may be affixed by suitable means (such as by bolts 458) to box member 436. Cover 456 may have a front face 460 to improve the appearance of the sign.

Sign frame 430 may also define suitable frame supporting members 462 for cooperating with frame members (not shown) to provide adequate structural support to sign frame 430.

It will thus be seen that the invention provides both for the use of two different information panels 16 and 18, by means of an intermediate face frame and an outer face frame, and also provides for the use of a flexible face material 104, which may be fastened in position in a secure and efficient manner.

In a further embodiment it is possible to provide a face frame construction which may be used either as an intermediate frame or as a frame for a flexible face material. For instance, the embodiment described in FIG. 4 may be used in association with the hinge retaining means (bolt 50) of FIG. 2 to support hinged front frame 12. Alternatively, the FIG. 4 embodiment could be used in association with the illustrated material holder means (core member 130, wrapping member 131 and bolt 132) to support a flexible face panel. In addition to or alternatively to the flexible face panel, the FIG. 4 embodiment may support a rigid face panel in the manner described in relation to FIG. 2. Other combinations of individual features of various embodiments may, of course, be used.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A face frame construction for use in association with a sign box of the type having a hinge recess, said face frame being adapted to support a thin flexible sign face material thereon, and comprising:

a generally rectangular frame having two end members, and top and bottom members, joining one another at corners, each said member having outer walls, said rectangular frame defining an inner zone and an outer zone;

face panel supporting means connected with said outer wall and having a continuous forwardly extending cantilever member defining a rim around said face frame for supporting such thin flexible material therein, said rim defining a foward edge;

a hinge formation connected to said outer wall along said top member at least, and extending in a rearward direction for hinging interengagement with said hinge recess aforesaid;

holder means for engaging edges of said thin flexible material and comprising at least one generally elongated channel formation, having side walls, and a generally curved bottom wall, defining a generally U-shaped cavity, with a reduced width open mouth portion, and a generally outwardly angled lip portion adjacent said reduced width mouth portion, whereby said flexible material may be formed around one of said outwardly angled lip formations; anchoring means whereby said flexible material may be secured within said cavity;

a recess defined by said face panel supporting means adapted to receive said holder means, and, fastening means adapted to extend from said holder means and openings in said frame, for receiving said fastening means whereby said holder means may be adjustably tightened up, thereby tensioning said material around said rim.

2. A face frame construction as claimed in claim 1 wherein said anchoring means comprises a wrapping member adapted to loosely fit within said cavity and to receive therearound a loop of said material, whereby said wrapping member may wedge said material against said side walls at said reduced width mouth portion.

3. A face frame construction as claimed in claim 1 including a front face cover portion removably attachable to said face frame, for at least partially covering said rim.

4. A face frame construction as claimed in claim 3 including retaining means on said sign box, for retaining said hinge formation in association with said hinge recess.

5. A face frame construction as claimed in claim 4 including sealing means associated with said sign box, adjacent said hinge recess, for sealing the same against entry of moisture during adverse weather conditions.

6. A face frame construction as claimed in claim 5 wherein said hinge recess on said sign box is of generally curved concave construction, and wherein said hinge formation on said face frame is of generally curved convex construction, mating with said hinge recess.

7. A face frame as claimed in claim 1 wherein said recess is oriented essentially perpendicular to the plane of said frame.

8. A face frame as claimed in claim 1 wherein the ends and inner side of said side walls define ridge and groove formations extending along the length of said channel formation.

9. A face frame construction for use in association with a structure defining an upper, essentially right-angled edge and an essentially vertical surface said face frame being adapted to support a thin flexible sign face material thereon, and comprising:

a generally rectangular frame having two end members, and top and bottom members, joining one another at corners, each said member having outer walls, said rectangular frame defining an inner zone and an outer zone;

essentially right-angled bracket means connected with said outer wall adapted to be secured to said edge by suitable fastening means;

bearing bracket means connected with said outer wall adapted to bear against said vertical surface;

face panel supporting means connected with said outer wall and defining a continuous forwardly extending rim;

holder means for engaging edges of said thin flexible material said holder means to be supported by said frame and adapted to hold said material around said rim, and, securing means for adjustably securing said holder means at different distances from the forward edge of said rim, thereby tensioning said material.

10. A face frame as claimed in claim 9 wherein said face panel supporting means further defines a holder surface oriented essentially perpendicular to the plane of said frame, and wherein said holder means is adapted to be supported adjacent said holder surface.

11. A face frame as claimed in claim 10 wherein said holder means comprises at least one channel formation, having side walls, said side walls defining an internal cavity therebetween and a reduced width open mouth portion whereby said cavity is able to communicate with the exterior, anchoring means whereby said flexible material may be secured within said cavity and reduced width open mouth portion and wherein said securing means comprises threaded fastening means adapted to extend through holes defined in said channel formation and threaded openings in said frame for receiving said fastening means, whereby said channel formations may be adjustably moved towards and away from said rim thereby adjusting the tension in said material.

12. A face frame as claimed in claim 11 wherein said anchoring means comprises a wrapping member adapted to loosely fit within said cavity and to receive therearound a loop of said material, whereby said wrapping member may wedge said material against said side walls at said reduced width mouth portion.

13. A face frame as claimed in claim 10 wherein the ends and inner side of said side walls define ridge and groove formations extending along the length of said channel formation.

* * * * *